US008756867B2

(12) United States Patent
Maxam

(10) Patent No.: US 8,756,867 B2
(45) Date of Patent: Jun. 24, 2014

(54) SYSTEM AND METHOD FOR CONSTRUCTING A STAGE

(75) Inventor: Noel Maxam, Los Angeles, CA (US)

(73) Assignee: Insta-Place LLC, Los Angeles, CA (US)

( * ) Notice: Subject to any disclaimer, the term of this patent is extended or adjusted under 35 U.S.C. 154(b) by 0 days.

(21) Appl. No.: 13/606,731

(22) Filed: Sep. 7, 2012

(65) Prior Publication Data

US 2014/0069025 A1 Mar. 13, 2014

(51) Int. Cl.
*E04H 3/26* (2006.01)

(52) U.S. Cl.
USPC ..... 52/6; 52/7; 446/111

(58) Field of Classification Search
USPC ..... 52/6, 7, 79.1, 126.4, 262, 270, 281, 52/284, 311.1, 311.2; 446/105, 106, 108, 446/109, 111, 112, 476; 472/77
See application file for complete search history.

(56) References Cited

U.S. PATENT DOCUMENTS

| | | | | | |
|---|---|---|---|---|---|
| 984,322 | A | * | 2/1911 | Van Sant | 472/77 |
| 1,022,020 | A | * | 4/1912 | Craig | 472/77 |
| 1,147,823 | A | * | 7/1915 | Smith | 472/77 |
| 2,052,178 | A | * | 8/1936 | Holden | 472/77 |
| 2,942,879 | A | | 6/1960 | Izenour | |
| 3,447,274 | A | * | 6/1969 | Davidson | 52/311.1 |
| 4,744,189 | A | * | 5/1988 | Wilson | 52/511 |
| 5,015,117 | A | * | 5/1991 | Pawlicki | 403/300 |
| 5,375,641 | A | | 12/1994 | Schlueter | |
| 5,626,926 | A | * | 5/1997 | Roberts | 428/14 |
| 6,106,186 | A | | 8/2000 | Taipale | |
| 2006/0150530 | A1 | | 7/2006 | Davey | |
| 2006/0160467 | A1 | | 7/2006 | Brock | |

OTHER PUBLICATIONS www.macksennettstage.com/flats.html, Scenery Flats, Aug. 23, 2007.*

* cited by examiner

*Primary Examiner* — Jeanette E Chapman
*Assistant Examiner* — Daniel Kenny
(74) *Attorney, Agent, or Firm* — Knobbe, Martens, Olson & Bear LLP

(57) ABSTRACT

An interchangeable kit for scenery having: a first wall unit and a second wall unit, each wall unit having: a first face to simulate a first surface, a second face to simulate a second surface different than the first surface and a plurality of first connector elements; an aperture unit comprising: a first face to simulate a first door or window, or having an operable first door or window; a second face to simulate a second door or window, or having an operable second door or window different than the first door or window and a plurality of second connector elements; and wherein the first plurality of connector elements connect a given wall unit to at least one other wall unit or aperture unit, and the second plurality of connector elements connect a given aperture unit to at least one other aperture or wall unit.

26 Claims, 7 Drawing Sheets

SYSTEM AND METHOD FOR CONSTRUCTING A STAGE

BACKGROUND OF THE INVENTION

The present invention relates to stages, such as in a theater, film or television production, and more particularly, to interchangeable stage scenery elements equipped for quick and inexpensive reuse and reorganization.

In typical stage construction, numerous specific stage elements such as doors, windows and walls are provided. Each element is typically used for a single purpose and is difficult to move and set up. For example, separate wall elements must be created and moved for masonry walls, wood walls and plaster walls. It is time consuming and expensive to create, set up and break down elaborate set elements.

Once put together, the set elements are often joined together to form a unified structure. The structure is typically kept together and moved as a unit in and out of a theater or stage which is time consuming and expensive. Moreover, the use of a unified set structure that is moved as a unit typically requires specialized moving equipment as well as a large facility for storing the structure when it is not being used.

Therefore, there is a need for an improved system and method for constructing stage scenery.

SUMMARY OF INVENTION

Accordingly, the present invention is directed to an interchangeable kit usable to make interchangeable scenery that remedies the shortcomings of the prior art. The kit, according to an embodiment, has a plurality of wall units, including at least a first wall unit and a second wall unit. Each of the first wall unit and the second wall unit has a first face painted, textured or covered to simulate a first surface; a second face painted, textured or covered to simulate a second surface, the second surface being different than the first surface; and a plurality of first connector elements. The kit also has at least one aperture unit having a first face painted, textured or covered to simulate a first door or window, or having an operable first door or window; a second face painted, textured or covered to simulate a second door or window, or having an operable second door or window, the second door or window being different than the first door or window and a plurality of second connector elements. A given connector element in the first plurality of connector elements is configured to connect a given wall unit to at least one other wall unit or aperture unit, and a given connector element in the second plurality of connector elements is configured to connect a given aperture unit to at least one other aperture or wall unit.

The first face of at least one wall unit may be painted, textured or covered to simulate an interior surface and the second face of the wall unit is painted, textured or covered to simulate an exterior surface. The first face of the aperture unit may be painted, textured or covered to simulate an interior window or door and the second face of the aperture unit may be painted, textured or covered to simulate an exterior window or door. Optionally, the first face of the plurality of wall units is painted, textured or covered to simulate at least one of the group consisting of wood, brick, stucco, plaster and wallpaper. Optionally, the aperture unit is configurable as at least two of the group consisting of a single hinged door, double hinged doors, a sliding door, a pocket door and elevator doors.

Additionally, the aperture unit may be configured to store multiple doors or windows of different types within a receiving area between a first wall of the aperture unit and a second wall of the aperture unit. In an additional embodiment, at least one of the first face and the second face of each of the plurality of wall units further comprises a plurality of fasteners for attaching a panel to the wall unit; and the kit has at least one panel coupleable to at least one wall unit. In another embodiment, at least one of the first face and the second face of each of the plurality of wall units has a plurality of relief pieces for attaching an insert to the wall unit; and wherein the kit has at least one insert coupleable to at least one wall unit.

In an additional embodiment, there are hooks on at least one of a top and a bottom of each wall unit and on at least one of a top and a bottom of the door and window unit, the hooks being strong enough to allow for the wall unit and the door and window unit to be picked up by the hooks. In another embodiment, there are spindle holes in at least one of a top and a bottom of each wall unit and in at least one of a top and a bottom of the door and window unit. The spindle holes are configured for the insertion of a spindle such that each of the plurality of wall units and the door and window unit may be rotatable to change the orientation of the first face and the second face. Optionally, each of the plurality of wall units and the aperture unit are prewired for attaching lights.

In an additional embodiment, the kit also has a plurality of floor units, each floor unit having a first face with a first design; a second face with a second design thereon, the second design being different than the first design; and a plurality of connector slots. Connectors are removeably slidable in the connector slots to removeably couple the plurality of floor units together. Optionally, at least one of the first face and the second face of the floor units is painted, colored or textured to simulate at least one of the group consisting of marble, stone, brick, cement, asphalt, wood plank, tile and linoleum.

In an embodiment, the first plurality of connector elements and the second plurality of connector elements comprise connector slots configured to removably receive connector devices to removeably couple the plurality of wall units and the at least one aperture unit. Optionally, the first plurality of connector elements and the second plurality of connector elements comprise snaps. Additionally, at least a portion of the first connector elements and the second connector elements may comprise magnets. Optionally, at least one wall unit has a green screen. In an additional embodiment of the present invention, at least one of the first wall unit and the second wall unit further comprises a third face painted, textured or covered to simulate a third surface, the third surface being different than the first surface and the second surface.

In an additional embodiment, the kit further comprises at least one stair unit, the stair unit having a lower base; a plurality of stairs coupled to each other, at least one stair being coupled to the lower base; and an upper base coupled to at least one of the stairs. At least one of the lower base and the upper base further comprise a plurality of connector elements. Optionally, the kit also has at least one landing unit coupleable to the upper base of the stair unit.

The present invention is also directed to a method for interchangeably constructing a stage. The method, according to an embodiment, has the steps of: providing a kit having a plurality of wall units, each wall unit having: a first face painted, textured or covered to simulate a first surface; a second face painted, textured or covered to simulate a second surface, the second surface being different than the first surface; and a plurality of connector slots; at least one aperture unit comprising: a first face painted, textured or covered to simulate a first door or window; a second face painted, textured or covered to simulate a second door or window, the second door or window being different than the first door or window; and a plurality of connector slots; and a plurality of connectors removeably mountable in the wall unit connector slots and the aperture unit connector slots to removeably couple the plurality of wall units and the at least one aperture unit. The method further includes the steps of coupling at least two of the plurality of wall units to each other using the connectors; and coupling the window and door unit to at least one of the wall units using the connectors.

In an additional embodiment, a bottom of each wall unit has a spindle hole and the method further includes the steps of: mounting at least one wall unit on a spindle; rotating the wall unit to change the orientation of the wall unit; and removing the at least one wall unit from the spindle. Optionally, the kit further comprises a plurality of floor units each floor unit having: a first face having a first design thereon; a second face having a second design thereon, the second design being different than the first design; and a plurality of connector slots; and wherein the method further comprises: placing the plurality of floor units proximal to the plurality of wall units and the window and door unit; and removably connecting the plurality of floor units to each other. Optionally, the method further comprises the steps of: uncoupling the floor units from each other; turning over a plurality of the floor units; and re-coupling the floor units to each other.

In an additional embodiment, the kit further comprises at least one stair unit and at least one landing unit; and the method further comprises: positioning the at least one stair unit proximal to at least one wall unit; and connecting the at least one landing unit to the stair unit.

In an additional embodiment, the present invention is directed to an interchangeable stage kit having a plurality of wall units, each wall unit further having: a first face painted, textured or covered to simulate a first surface; a second face painted, textured or covered to simulate a second surface, the second surface being different than the first surface; and a plurality of connector slots. The kit also has a plurality of aperture units, each aperture unit having: a first face painted, textured or covered to simulate a first door or window; a second face painted, textured or covered to simulate a second door or window, the second door or window being different than the first door or window; and a plurality of connector slots.

The kit also has a plurality of floor units, each floor unit further comprising: a first face having a first design thereon; a second face having a second design thereon, the second design being different than the first design; and a plurality of connector slots. The kit also has a plurality of connectors removeably mountable in the wall unit connector slots, the aperture unit connector slots and the floor unit connector slots to removeably couple the plurality of wall units, the at least one aperture unit and the floor units. In an additional embodiment, the kit also has at least one stair unit, the stair unit having: a lower base; a plurality of stairs coupled to each other, at least one stair being coupled to the lower base; and an upper base coupled to at least one of the stairs; wherein the lower base and the upper base further comprise a plurality of connector slots.

BRIEF DESCRIPTION OF THE DRAWINGS

The features, aspects and advantages of the present invention will become better understood with regard to the following description, appended claims and accompanying figures wherein:

DETAILED DESCRIPTION OF THE PREFERRED EMBODIMENTS

In the following description of the preferred embodiments, reference is made to the accompanying drawings which show by way of illustration specific embodiments in which the invention may be practiced. Wherever possible, the same reference numbers will be used throughout the drawings to refer to the same or like parts. It is to be understood that other embodiments may be utilized and structural and functional changes may be made without departing from the scope of the present invention.

Figure 1B:
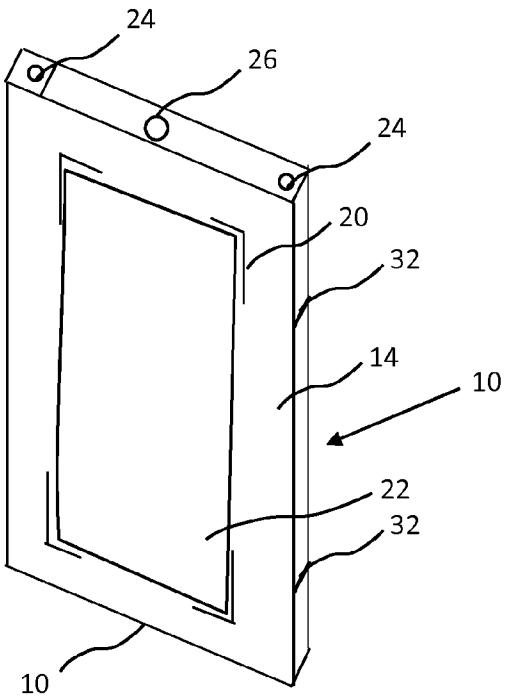
FIG. 1B is a schematic drawing of the wall unit of FIG. 1A turned over and around.
Figure 1A:
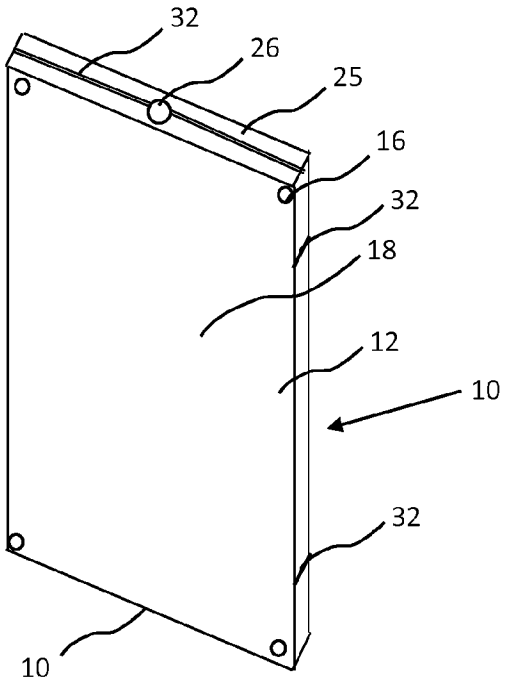
FIG. 1A is a schematic drawing of a wall unit according to an embodiment of the present invention.

The present invention is directed to a system and method for constructing a set that utilizes modular components, such as modular wall units, door units, flooring units and stair units. A modular wall unit 10 according to an embodiment of the present invention is shown in FIGS. 1A and 1B. The wall unit 10 may be used for creating an interior or exterior wall. The wall unit has a first face 12 and a second face 14. The first face 12 and/or the second face 14 may be painted, textured or covered to simulate a surface, for example wood, brick, stucco, plaster or wallpaper.

The first face 12 or the second face 14 may have a plurality of fasteners 16, such as for example rivets, snaps, hook and loop fasteners, or magnets, for attaching panels 18 to the face. The panels may simulate a surface such as wood, brick, stucco, plaster or wallpaper and may be, for example, painted or pre-printed. Additionally, one or both faces may have a plurality of relief pieces 20 for holding an insert 22, such as a fabric piece to simulate a wall material.

Figure 2:
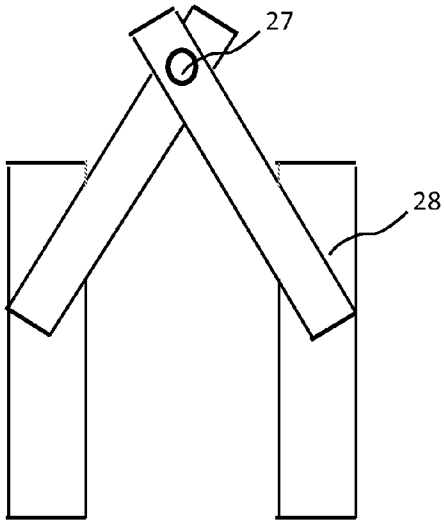
FIG. 2 is a schematic drawing of a spindle and forklift attachment usable with the wall unit of FIG. 1A.

Additionally, the wall unit 10 may have riggable hooks 24, such as on a top 25, for allowing the modular wall to be lifted in and out of location, such as by a crane or a forklift. Alternatively, instead of hooks, magnets or other coupling devices may be used for allowing the wall unit 10 to be lifted in and out of location. Additionally, the wall unit 10 may have a spindle hole 26 in the top 25 or a bottom for fitting of a spindle 27 such as shown in FIG. 2.

The spindle 27 may be mounted on a studio floor or on a forklift using a forklift assembly 28 and rotatably fit within the spindle hole 26 for allowing the wall unit 10 to be rotated on the spindle to change viewing from the first face 12 to the second face 25 or from the second face 14 to the first face 12. In an embodiment, the wall unit 10 is raised using riggable hooks 24, positioned on spindle 27, rotated 180 degrees until facing the opposite direction, lifted off of the spindle using the riggable hooks 24, the spindle 27 removed and the wall unit 10 placed back down.

In an embodiment, one face of the wall unit 10 can be configured as an interior wall and the other face of the wall unit 10 configured as an exterior wall. The wall unit 10 may be covered with a slipcover to simulate a surface, for example wood, brick, stucco, plaster or wallpaper. The wall unit may be painted or covered to have the appearance of three-dimensional architectural features, such as columns and bookcases on at least one side. In an additional embodiment, one side of the wall unit may be painted or covered as a green screen for use in virtual sets. In an embodiment, the wall unit 10 may be prewired for attaching lights or other fixtures to the wall unit 10.

Figure 3:
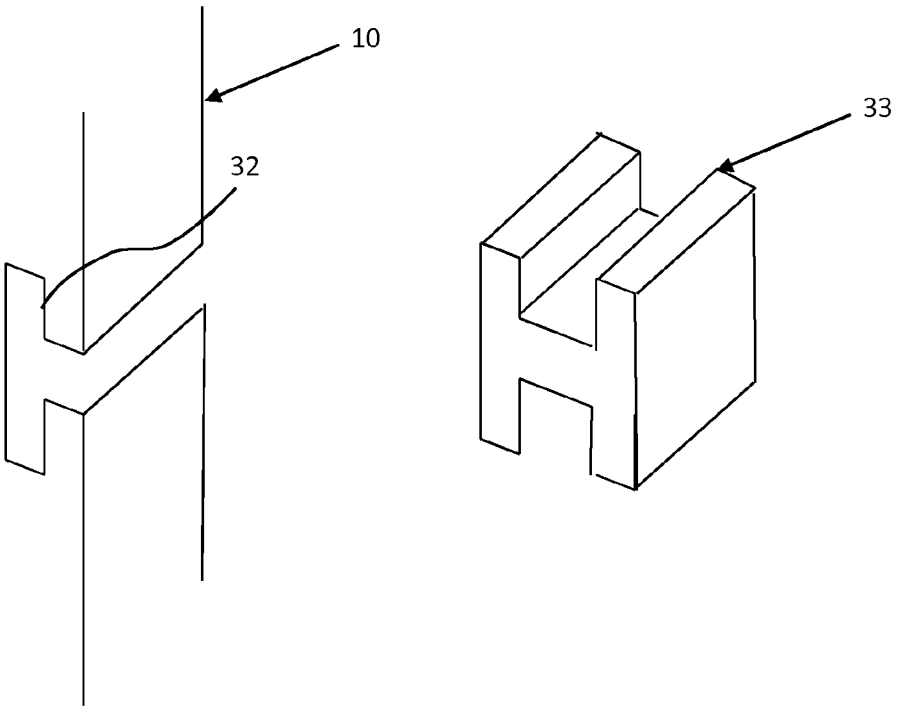
FIG. 3 is a schematic drawing of an enlarged view of a connector slot of the wall unit of FIG. 1A and a connector configured for use with the connector slot.

In an embodiment, as shown in FIGS. 1A, 1B and 3, each of the wall units have a plurality of connector slots 32 for coupling wall panels to each other, such as for creating differently sized walls, and to other components. The use of connector slots 32 with connectors 33 that slidably engage in the connector slots allows for quick joining of wall panels to each other and to other components without the use of specialized tools. When not in use, if necessary, plugs may be placed in the connector holes to hide the connector holes. Connectors may be created for joining adjacent components in a plane, such as the connector shown in FIG. 3, or at an angle, such as about ninety-degrees to form a corner. Alternatively, other coupling devices and fasteners such as magnets, brackets or snaps may be used for joining wall units 10 to each other and to other components.

The wall units 10 may be configured as flat or curved pieces; the use of curved wall units of different radii allows for the creation of curved structures, such as turrets. When not in use, the wall units 10 may be stacked and moved, for example, on pallets or in standard containers. This saves storage space and eases crating and shipping. The structure of the wall units 10 are made to be weight bearing, sturdy and safe. The internal structure of the wall units 10 may be made from one or more of, for example, wood, aluminum and steel. The faces of the wall units 10 can be made with any suitable covering material and may be made with at least one of, for example, wood, aluminum, steel, glass, plastic and multi-vinyl castings.

An aperture unit 40 according to an embodiment of the present invention is shown in FIG. 3. The aperture unit may be used for creating an interior or exterior door or window. The aperture unit has a first face 42 and a second face 44. The first face 42 and/or the second face 44 may be painted, textured or covered to simulate a surface, such as for example wood, brick, stucco, plaster or wallpaper. In an embodiment, the first face 42 may be configured as an interior surface and the second face 44 may be configured as an outside surface. In an additional embodiment, the first face 42 or the second face 44 may be painted or covered as a green screen for use in virtual sets.

The first face 42 or the second face 44 may have a plurality of fasteners 46, such as for example rivets, snaps, or magnets, for attaching panels 48 to the face. The panels 48 may simulate a surface such as wood, brick, stucco, plaster or wallpaper. Additionally, the panels may simulate an architectural feature such as different types of doors or windows. The panels may be, for example, painted or pre-printed. The aperture unit may have functional doors and windows that may open and close. The aperture unit 40 may be used to simulate, for example, plastic (such as polyvinyl chloride or vinyl) windows, aluminum windows, wood windows, interior doors with panel inserts and exterior doors with panel inserts. Likewise, the aperture unit 40 may be used to simulate, for example, hinged or sliding doors, pocket doors, dutch doors, elevators and closets.

The front and back of the functional doors and windows may be different types or the same type. Also, for a given door, each side of the door may appear to be an exterior door with different styles, each side of the door may appear to be an interior door with different styles, or one side of the door may appear to be an exterior door with one style, and the other side of the door may appear to be an interior door with a different style.

Additionally, the first face 42 and the second face 44 may have a plurality of relief pieces 50 for holding an insert, such as a fabric piece to simulate a door or window material. In an additional embodiment, the door and window unit 40 is prewired for connection of lights, such as lamps. Optionally, frosted glass panels can be held in the plurality of relief pieces 50 and backlit, such as by LED's to further simulate a frosted glass door.

The aperture unit 40 may be configured as a single or double hinge door. To facilitate multiple configurations, the aperture unit 40 has two holes 52 for insertion of door hardware, each hole being fillable with a matched plug 54 to hide the hole if desired. Likewise, to facilitate multiple configurations, the aperture unit 40 may have a removable molding mountable on the door and window unit to hide door hinges 56. The use of the removable molding(s) along with matched plugs allows for the door and window unit to be used a single door set element or a regular wall instead of a double door.

In an embodiment, the aperture unit 40 has a thickness suitable to accommodate a pocket door slider 58. The aperture unit 40 may have riggable hooks 60, such as on a top 62 for allowing the aperture unit to be lifted in and out of location, such as by a crane or a forklift. Alternatively, instead of hooks, magnets or other coupling devices may be used for allowing the aperture unit 40 to be lifted in and out of location. Additionally, the aperture unit 40 may be have a spindle hole 64 in the top 62 or a bottom for fitting of a spindle (not shown). The spindle may be mounted on a studio floor or on a forklift and rotatably fit within the spindle hole 62 for allowing the aperture unit 40 to be rotated on the spindle to change viewing from the first face 42 to the second face 44 or from the second face 44 to the first face 42. Multiple doors of different types may be stored in a pocket in the wall unit 10 or in a pocket in the aperture unit 40 and different doors may be removed from the pocket and used with the aperture unit 40 depending on the desired appearance for the set.

Figure 4:
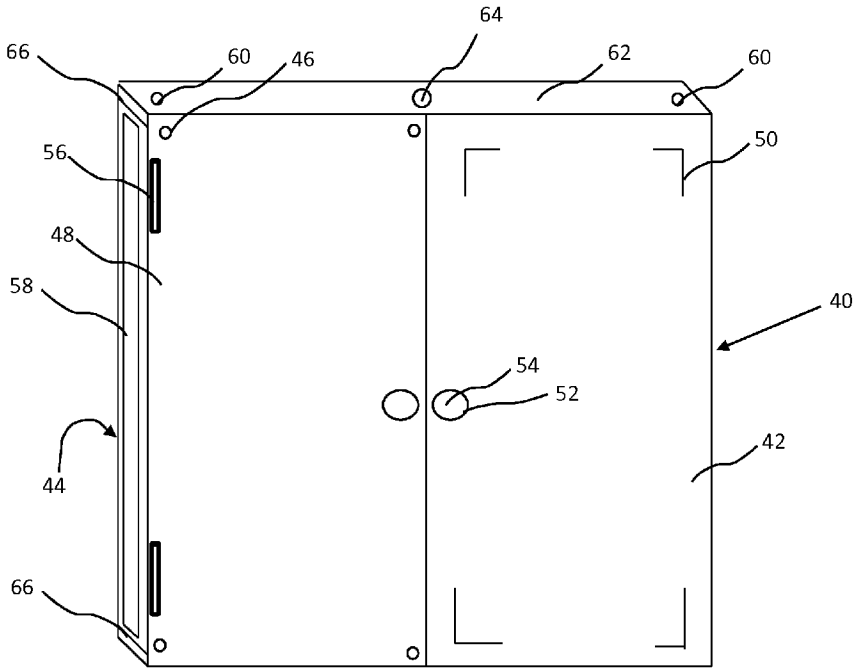
FIG. 4 is a schematic drawing of a door unit according to an embodiment of the present invention.

In an embodiment, as shown in FIG. 4, each of the aperture units 40 have a plurality of connector slots 66 for coupling window and door units 40 to each other and to wall units 10. The use of connector slots 66 with connectors 33 that slidably engage in the connector slots 66 allows for quick joining of window and door panels 40 to each other and to other components without the use of specialized tools. When not in use, if necessary, plugs may be placed in the connector holes to hide the connector holes. Connectors may be created for joining adjacent components in a plane, such as the connector shown in FIG. 3, or at an angle, such as about ninety-degrees to form a corner. Alternatively, other coupling devices and fasteners such as magnets, brackets or snaps may be used as connector elements for joining aperture units 40 to each other and to other components.

In an embodiment, one face of the aperture unit 40 may be configured as an interior window or door and the other face of the aperture unit 40 configured as an exterior window or door. The aperture unit 40 may be covered with a slipcover to simulate a surface, such as wood, brick, stucco, plaster or wallpaper, as well as architectural features such as various types of windows or doors. The aperture unit 40 may be painted or covered to have the appearance of three-dimensional architectural features, such as columns and bookcases on at least one side.

In an additional embodiment, one side of the aperture unit 40 may be painted or covered as a green screen for use in virtual sets. Multiple windows of different types may be stored in a pocket in the wall unit 10 or in a pocket in the aperture unit 40 and different windows may be removed from the pocket and used in the aperture unit 40 depending on the desired appearance for the set.

When not in use, the aperture units 40 may be stacked and moved, for example, on pallets or in standard containers. This saves storage space and eases crating and shipping. The structure of the aperture units 40 are made to be weight bearing, sturdy and safe. The internal structure of the aperture units 40 may be made from one or more of, for example, wood, aluminum and steel. The faces of the aperture units 40 can be made with any suitable material and may be made with at least one of, for example, wood, aluminum, steel, glass, plastic and multi-vinyl castings.

In an alternative embodiment of the present invention, the wall units 10 and the aperture units 40 may have more than 2 faces. For example, the wall units and/or window units 40 may be formed as cubes with 6 different faces. The cubes can be rotated to form 6 different sets.

A modular floor unit 80 according to an embodiment of the present invention is shown in FIGS. 4A and 4B. The floor unit 80 may be used for creating an interior or exterior floor. The floor unit 80 has a first face 82 and a second face 84. Each face may be painted, colored or textured to simulate a surface, such as for example marble, stone, brick, cement, asphalt, wood plank, tile or linoleum.

In a preferred embodiment, a first photograph is printed on the first face 82 and a second different photograph is printed on the second face 84. Each photograph can simulate a surface such as for example marble, stone, brick, cement, asphalt, wood plank, tile or linoleum. Preferably the modular floor unit is made from, for example, vinyl or wood.

In various embodiments, the internal structure of the modular floor unit may be made from one or more of, for example, wood, aluminum and steel. The faces of the modular floor unit can be made with any suitable material and may be made with at least one of, for example, wood, concrete, brick and multi-vinyl castings.

The floor unit 80 may be made in numerous different sizes and shapes, but is preferably square and from about 4 inches by about 4 inches to about 4 feet by about 4 feet in size. In an embodiment of the present invention, the floor unit may be magnetized for removeable attachment to an undersurface such as a sheet of steel. In a preferred embodiment, each floor unit 80 has a connector slot 86 along each face. The connector slots 86 may be configured similarly to the connector slots in the wall units 10 and the window and door units 40.

Figure 5B:
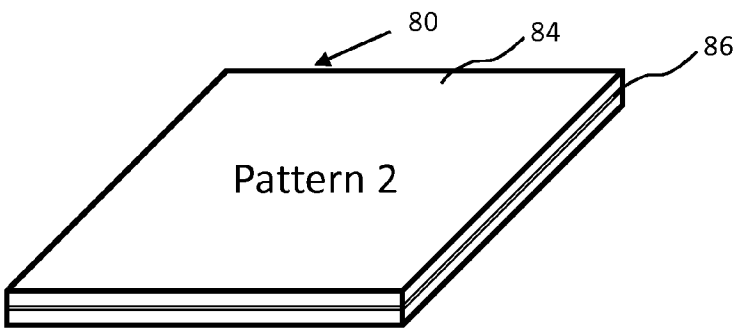
FIG. 5B is a schematic drawing of the floor unit of FIG. 5A turned over.
Figure 5A:
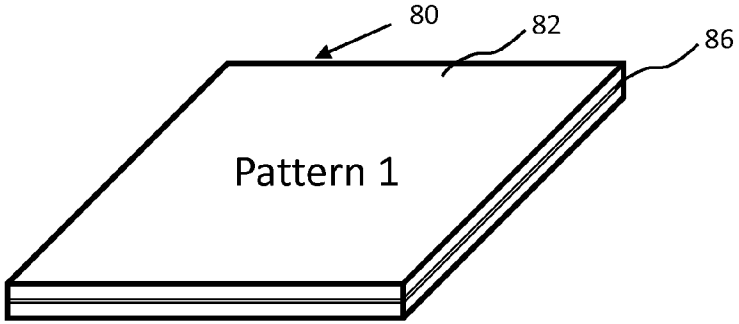
FIG. 5A is a schematic drawing of a floor unit according to an embodiment of the present invention.
Figure 6:
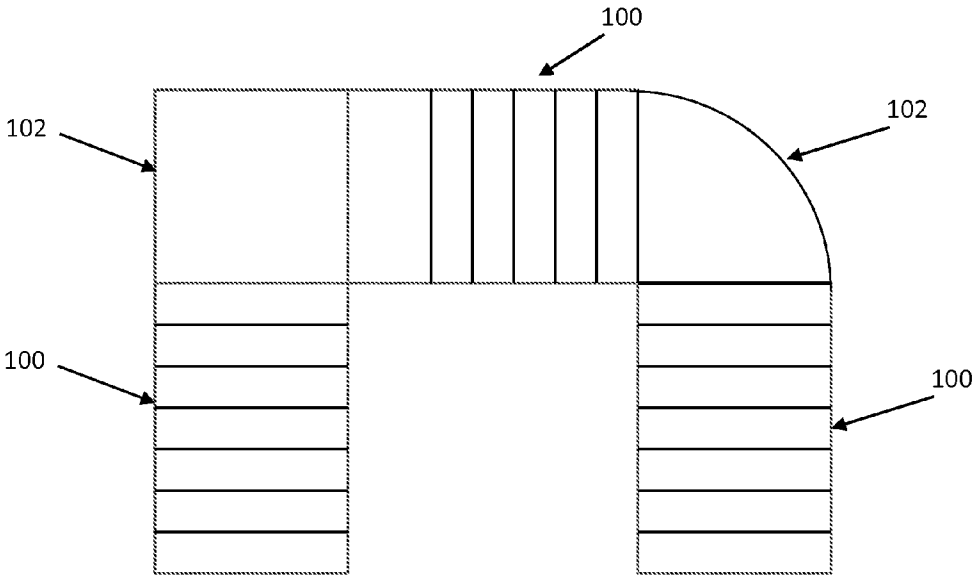
FIG. 6 is a schematic drawing of a stair unit according to an embodiment of the present invention.
Figure 7:
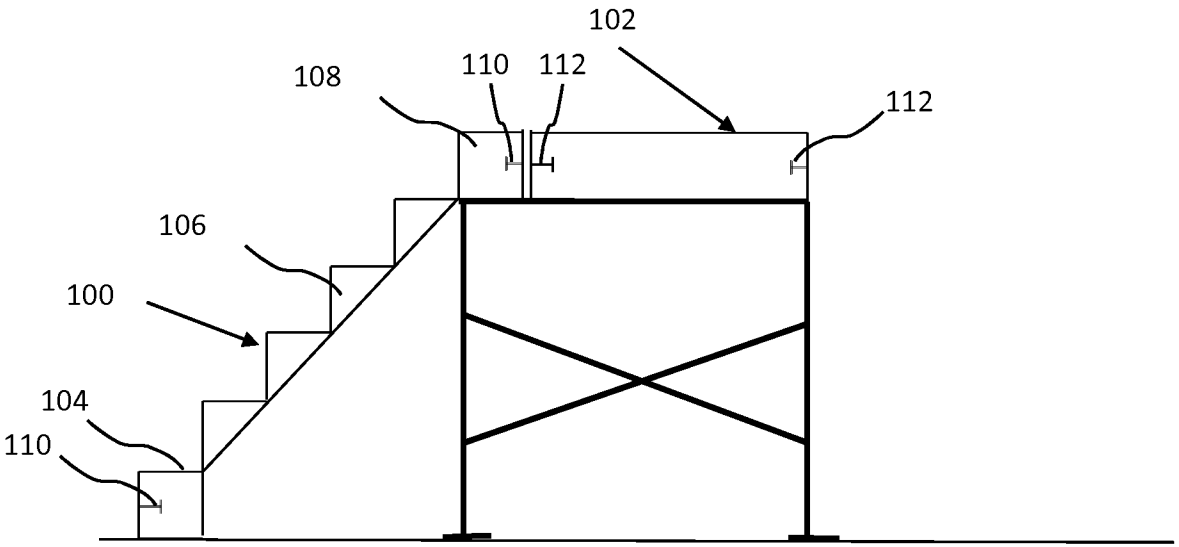
FIG. 7 is a cross-sectional view of the stair unit of FIG. 6.

A modular stair unit 100 and a modular landing unit 102 according to an embodiment of the present invention are shown in FIGS. 5 and 6. The stair unit 100 and landing unit 102 may be used for creating an interior or exterior stairway. The stair unit 100 and the landing unit 102 may each be painted, textured or covered to simulate a surface, such as for example wood, brick, marble or cement.

The stair unit 100 has a lower base 104, a series of steps 106 and an upper base 108. The size of the lower base 104 and the upper base 108 may be varied and may be configured to be the same size as one of the steps. The number and sizes of the steps 106 may be varied for different types of stairways. In an embodiment, the stair unit has between about 2 and about 20 stairs, preferably between about 5 and about 15 stairs, and more preferably between about 6 and about 12 stairs. The stair unit 100 may be held upright by resting the lower base 104 on the ground, a stage, or a first riser and the upper base on a higher riser or other support. Alternatively, the stair unit 100 may have supports and may stand upright without a riser or other support.

The stair unit 100 may have a connector slot 110 on the lower base 104 and the upper base 108 for connection to one or more additional stair units 100, landing units 102 or other components. Alternatively, other coupling devices and fasteners such as magnets, brackets or snaps may be used for joining stair units 100 to each other and to other components.

The stair unit 100 may be prewired to accommodate lights. The stair unit may also be fitted with holes in the lower base 104, the upper base 108 and one or more stairs 106 for the attachment of railings and/or banisters.

The stair units 100 are made to be weight bearing, sturdy and safe. The internal structure of the stair units 100 may be made from one or more of, for example, wood, aluminum and steel. The faces of the stairs and bases can be made with any suitable covering material and may be made with at least one of, for example, wood, glass and brick.

Landing unit 102 can be placed adjacent to the stair unit lower base 104 or upper base 108. The landing unit 102 can have a variety of different shapes, such as for example, square, rectangular, semicircular or pie shaped. The landing unit 102 may have a connector slot 112 on each of its sides for connection to one or more stair units 100 or to additional landing units 102. Alternatively, other coupling devices and fasteners such as magnets, brackets or snaps may be used for joining landing units 102 to each other and to other components.

The landing unit 102 may be prewired to accommodate lights. The structure of the landing units 102 are made to be weight bearing, sturdy and safe. The internal structure of the landing units 102 may be made from one or more of, for example, wood, aluminum and steel. The landing units 102 can be covered with any suitable covering material such as, for example, wood, glass, brick, carpet and vinyl castings.

In an embodiment of the present invention, a plurality of wall units 10 and window and door units 40 and connectors 33 are sold in a kit. The kit is unpacked and the wall units 10 and window and door units 40 are connected to each other as needed using the connectors 33 to form a stage as desired. Optionally, the kit further includes floor units 80, which may be placed adjacent to the wall units 10 and the window and door units 40 and coupled to each other using the connectors 33. Optionally, the kit further includes a plurality of stair units 100 and landing units 102, which may be placed adjacent to the wall units and the window and door units 40 and coupled to each other using the connectors 33.

After the stage is put together using the connectors, if it becomes desirable to change the stage, the wall units and the window and door units may have panels, insets, or covers changed. Additionally, the door units and the window and door units may be rotated 180 degrees. Additionally, the floor units may be flipped over. Additionally, the configuration of the stair units and the landing units may be changed.

As an example use of the system according to an embodiment of the present invention, wall units 10, window and door units 40 may be configured as a standard newsroom on one face and a living room on the other face, thereby allowing the wall units 10 and window units 40 to be rotated 180 degrees to change from the newsroom set to the living room set. As an additional example use of the system according to an embodiment of the present invention, wall units 10, window and door units 40 and floor units 80 are used to simulate the interior of the Oval Office of the White House on one face and an exterior of the White House on the other face, thereby allowing the wall units 10, window units 40 and floor units 80 to be rotated 180 degrees to change a set from the interior of the Oval Office to the exterior of the White House.

There is disclosed in the above description and the drawings, an improved system and method for constructing a stage which overcomes the disadvantages associated with the prior art. However, it will be apparent that variations and modifications of the disclosed embodiments may be made without departing from the principles of the invention. The presentation of the preferred embodiments herein is offered by way of example only and not limitation, with a true scope and spirit of the invention being indicated by the following claims.

Any element in a claim that does not explicitly state "means" for performing a specified function or "step" for performing a specified function, should not be interpreted as a "means" or "step" clause as specified in 35 U.S.C. §112.

What is claimed is:

1. An interchangeable kit usable to make interchangeable scenery, the kit comprising:

a plurality of wall units, including at least a first wall unit and a second wall unit, wherein each of the first wall unit and the second wall unit further comprise:

a first face painted, configured to removably receive a first panel textured or covered to simulate a first surface;

a second face painted, configured to removably receive a first panel textured or covered to simulate a second surface, the second surface being different than the first surface;

a plurality of first connector elements;

at least one aperture unit comprising a receiving area configured to receive an operable door that opens and closes or an operable window that opens and closes:

a plurality of second connector elements the second connector elements different than the first connector elements; and wherein a given connector element in the first plurality of connector elements is configured to removably connect a given wall unit directly to at least one other wall unit or aperture unit, in a plane and a given connector element in the second plurality of connector elements is configured to removably connect a given aperture unit directly to at least one other aperture or wall unit at an angle of about ninety degrees to form a ninety degree corner.

2. The interchangeable kit of claim 1 wherein the first face of at least one wall unit is painted, textured or covered to simulate an interior surface and the second face of the wall unit is painted, textured or covered to simulate an exterior surface; and wherein the first face of the aperture unit is painted, textured or covered to simulate an interior window or door and the second face of the aperture unit is painted, textured or covered to simulate an exterior window or door.

3. The interchangeable kit of claim 1 wherein the first face of the plurality of wall units is painted, textured or covered to simulate at least one of the group consisting of wood, brick, stucco, plaster and wallpaper.

4. The interchangeable kit of claim 1 wherein the aperture unit is configurable as at least two of the group consisting of a single hinged door, double hinged doors, a sliding door, a pocket door and elevator doors.

5. The interchangeable kit of claim 1 wherein the aperture unit is configured to store multiple doors or windows of different types within a receiving area between a first wall of the aperture unit and a second wall of the aperture unit.

6. The interchangeable kit of claim 1 wherein at least one of the first face and the second face of each of the plurality of wall units further comprises a plurality of fasteners for attaching a panel to the wall unit; and wherein the kit further comprises at least one panel coupleable to at least one wall unit.

7. The interchangeable kit of claim 1 wherein at least one of the first face and the second face of each of the plurality of wall units further comprises a plurality of relief pieces for attaching an insert to the wall unit; and wherein the kit further comprises at least one insert coupleable to at least one wall unit.

8. The interchangeable kit of claim 1 further comprising a hook on at least one of a top and a bottom of each wall unit and on at least one of a top and a bottom of the aperture unit, the hook being strong enough to allow for the wall unit and the aperture unit to be picked up by the hook.

9. The interchangeable kit of claim 1 further comprising a spindle hole in at least one of a top and a bottom of each wall unit and in at least one of a top and a bottom of the aperture unit;

wherein the spindle holes are configured for the insertion of a spindle such that each of the plurality of wall units and the aperture unit may be rotatable to change the orientation of the first face and the second face.

10. The interchangeable kit of claim 1 wherein each of the plurality of wall units and the aperture unit are prewired for attaching lights.

11. The interchangeable kit of claim 1 further comprising a plurality of floor units, each floor unit further comprising:

a first face having a first design thereon;

a second face having a second design thereon, the second design being different than the first design;

a plurality of connector slots; and a plurality of connectors removeably slidable in the connector slots to removeably couple the plurality of floor units together.

12. The interchangeable kit of claim 10 wherein at least one of the first face and the second face of the floor units is painted, colored or textured to simulate at least one of the group consisting of marble, stone, brick, cement, asphalt, wood plank, tile and linoleum.

13. The interchangeable kit of claim 1, wherein the first plurality of connector elements and the second plurality of connector elements comprise connector slots configured to removably receive connector devices to removeably couple the plurality of wall units and the at least one aperture unit.

14. The interchangeable kit of claim 1, wherein the first plurality of connector elements and the second plurality of connector elements comprise snaps.

15. The interchangeable kit of claim 1, wherein at least a portion of the first connector elements and the second connector elements comprise magnets.

16. The interchangeable kit of claim 1, further comprising at least one wall unit having a green screen.

17. The interchangeable kit of claim 1, wherein at least one of the first wall unit and the second wall unit further comprises a third face painted, textured or covered to simulate a third surface, the third surface being different than the first surface and the second surface.

18. The interchangeable kit of claim 1 further comprising at least one stair unit, the stair unit further comprising:

a lower base;

a plurality of stairs coupled to each other, at least one stair being coupled to the lower base; and an upper base coupled to at least one of the stairs;

wherein at least one of the lower base and the upper base further comprise a plurality of connector elements.

19. The interchangeable kit of claim 18 further comprising at least one landing unit coupleable to the upper base of the stair unit.

20. A method for interchangeably constructing a stage, comprising:

providing a kit comprising:

a plurality of wall units, each wall unit further comprising:

a first face painted, textured or covered to simulate a first surface;

a second face painted, textured or covered to simulate a second surface, the second surface being different than the first surface; and and a plurality of connector slots at least one aperture unit comprising:

a first face painted, textured or covered to simulate a first door or window;

a second face painted, textured or covered to simulate a second door or window, the second door or window being different than the first door or window; and a plurality of connector slots; and a plurality of floor units, each floor unit further comprising:

a first face having a first design thereon;

a second face having a second design thereon, the second design being different than the first design; and a plurality of connector slots;

a plurality of connectors removeably mountable in the wall unit connector slots and the aperture unit connector slots to removeably couple the plurality of wall units and the at least one aperture unit;

coupling at least two of the plurality of wall units to each other using the connectors; and coupling the aperture unit to at least one of the wall units using the connectors.

21. The method of claim 20 wherein a bottom of each wall unit further comprises a spindle hole and the method further comprises the steps of:

mounting at least one wall unit on a spindle;

rotating the wall unit to change the orientation of the wall unit; and removing the at least one wall unit from the spindle.

22. The method of claim 21 wherein the kit further comprises a plurality of floor units each floor unit further comprising: a first face having a first design thereon; a second face having a second design thereon, the second design being different than the first design; and a plurality of connector slots; and wherein the method further comprises:

placing the plurality of floor units proximal to the plurality of wall units and the window and door unit; and removably connecting the plurality of floor units to each other.

23. The method of claim 22 wherein the method further comprises the steps of:

uncoupling the floor units from each other;

turning over a plurality of the floor units; and re-coupling the floor units to each other.

24. The method of claim 20 wherein the kit further comprises at least one stair unit and at least one landing unit; and the method further comprises:

positioning the at least one stair unit proximal to at least one wall unit; and connecting the at least one landing unit to the stair unit.

25. An interchangeable stage kit comprising:

a plurality of wall units, each wall unit further comprising:

a first face painted, textured or covered to simulate a first surface;

a second face painted, textured or covered to simulate a second surface, the second surface being different than the first surface;

a plurality of connector slots;

a plurality of aperture units, each aperture unit further comprising:

a first face painted, textured or covered to simulate a first door or window;

a second face painted, textured or covered to simulate a second door or window, the second door or window being different than the first door or window;

a plurality of connector slots;

a plurality of floor units, each floor unit further comprising:

a first face having a first design thereon;

a second face having a second design thereon, the second design being different than the first design; and a plurality of connector slots; and a plurality of connectors removeably mountable in the wall unit connector slots, the aperture unit connector slots and the floor unit connector slots to removeably couple the plurality of wall units, the at least one aperture unit and the floor units.

26. The interchangeable stage kit of claim 25 further comprising:

at least one stair unit, the stair unit further comprising:

a lower base;

a plurality of stairs coupled to each other, at least one stair being coupled to the lower base; and an upper base coupled to at least one of the stairs;

wherein the lower base and the upper base further comprise a plurality of connector slots.

* * * * *

UNITED STATES PATENT AND TRADEMARK OFFICE

CERTIFICATE OF CORRECTION

PATENT NO. : 8,756,867 B2
APPLICATION NO. : 13/606731
DATED : June 24, 2014
INVENTOR(S) : Noel Roger Maxam It is certified that error appears in the above-identified patent and that said Letters Patent is hereby corrected as shown below:

In the Claims

In column 9 at lines 22-23, In Claim 1, change "painted, configured to removably receive a first panel" to --configured to removably receive a first panel painted,--.

In column 9 at lines 25-26, In Claim 1, change "painted, configured to removably receive a first panel" to --configured to removably receive a second panel painted,--.

In column 11 at line 15 (approx.), In Claim 20, change "and a" to --a--.

Signed and Sealed this
Twenty-seventh Day of January, 2015

Michelle K. Lee

Michelle K. Lee
*Deputy Director of the United States Patent and Trademark Office*